US005174182A

United States Patent [19]

Rosenthal et al.

[11] Patent Number: 5,174,182

[45] Date of Patent: Dec. 29, 1992

[54] MACHINE FOR FEEDING AND CUTTING SHEET MATERIAL

[75] Inventors: Ben J. Rosenthal, Winnetka; Gregory Starr; Arkady Kats, both of Buffalo Grove, all of Ill.

[73] Assignee: Rosenthal Manufacturing Co., Chicago, Ill.

[21] Appl. No.: 832,730

[22] Filed: Feb. 7, 1992

[51] Int. Cl.[5] ..... B26D 1/38

[52] U.S. Cl. ..... 83/63; 83/436; 83/568; 83/823; 83/824; 226/90; 226/187

[58] Field of Search ..... 83/156, 436, 824, 649, 83/949, 583, 823, 58, 63, 568; 226/87, 90, 187

[56] References Cited

U.S. PATENT DOCUMENTS

| | | | |
|---|---|---|---|
| 1,543,183 | 6/1925 | Mortimer | 83/649 X |
| 1,585,543 | 5/1926 | Horold | 83/823 X |
| 1,819,727 | 8/1931 | Aspenleiter | 83/583 X |
| 2,108,496 | 2/1938 | Link | 83/649 X |
| 2,301,229 | 11/1942 | Sigoda | 83/583 X |
| 2,454,241 | 11/1948 | Wennerberg | 83/583 X |
| 3,760,669 | 9/1973 | Rosenthal et al. | 83/63 |
| 3,971,279 | 7/1976 | Wright | 83/649 X |
| 4,676,131 | 6/1987 | Cassia | 83/649 X |

*Primary Examiner*—Douglas D. Watts
*Assistant Examiner*—Kenneth E. Peterson
*Attorney, Agent, or Firm*—Allegretti & Witcoff, Ltd.

[57] ABSTRACT

A machine for feeding and cutting sheet material includes a housing and a framework pivoted on the housing to permit loading of sheet material into the machine. A feed roll is journalled in the housing. A cooperating pressure roll is journalled on the framework. A spring is adjustably carried on the framework for adjusting the pressure of the pressure roll toward the feed roll. A knife blade on the framework, and fixed to the framework cooperates with a movable knife blade in the housing for cutting predetermined lengths of sheet material. A cam follower bearing is provided in the housing to help guide movement of the knife blade in the housing. A spring adjustment is provided in the linkage connecting the cylinder driving the movable knife blade and the movable knife blade for varying the force of the movable knife blade against the cam roller bearing. A safety interlock in circuit with the drive motor for the feed roll will stop the drive motor when there is a jam of sheet material in the machine in use or if the framework is open.

5 Claims, 4 Drawing Sheets

MACHINE FOR FEEDING AND CUTTING SHEET MATERIAL

BACKGROUND OF THE INVENTION

This invention relates to an improved machine for feeding and cutting sheet material.

One known sheet material feeding and cutting machine is shown in U.S. Pat. No. 3,760,669. The known machine is relatively large and it is desired to provide a smaller and more compact machine which incorporates enhanced loading, operation, and safety characteristics.

An object of the present invention is to provide an improved machine for feeding and cutting sheet material which is compact and includes knife means comprising a stationary upper knife cooperating in a unique fashion with a moving knife for cutting the sheet material to selected lengths.

A further object of this invention is to provide an improved machine for feeding and cutting sheet material which includes knife means having two knife blades, one fixed and one movable, and an adjustment for the cooperative engagement of the two knife blades.

Another object of the present invention is to provide an improved machine for feeding and cutting sheet material that incorporates a safety switch for terminating operation of the machine in the event of jam or erroneous pass of sheet material through the machine or in the event that the framework supporting the upper knife and a pressure roll is open. Other objects and advantages of the present invention will be made more apparent hereinafter.

BRIEF DESCRIPTION OF THE DRAWING

There is shown in the attached drawing a presently preferred embodiment of the present invention, wherein like numerals refer to like elements in the views and wherein.

DETAILED DESCRIPTION OF THE PRESENT INVENTION

Figure 1:
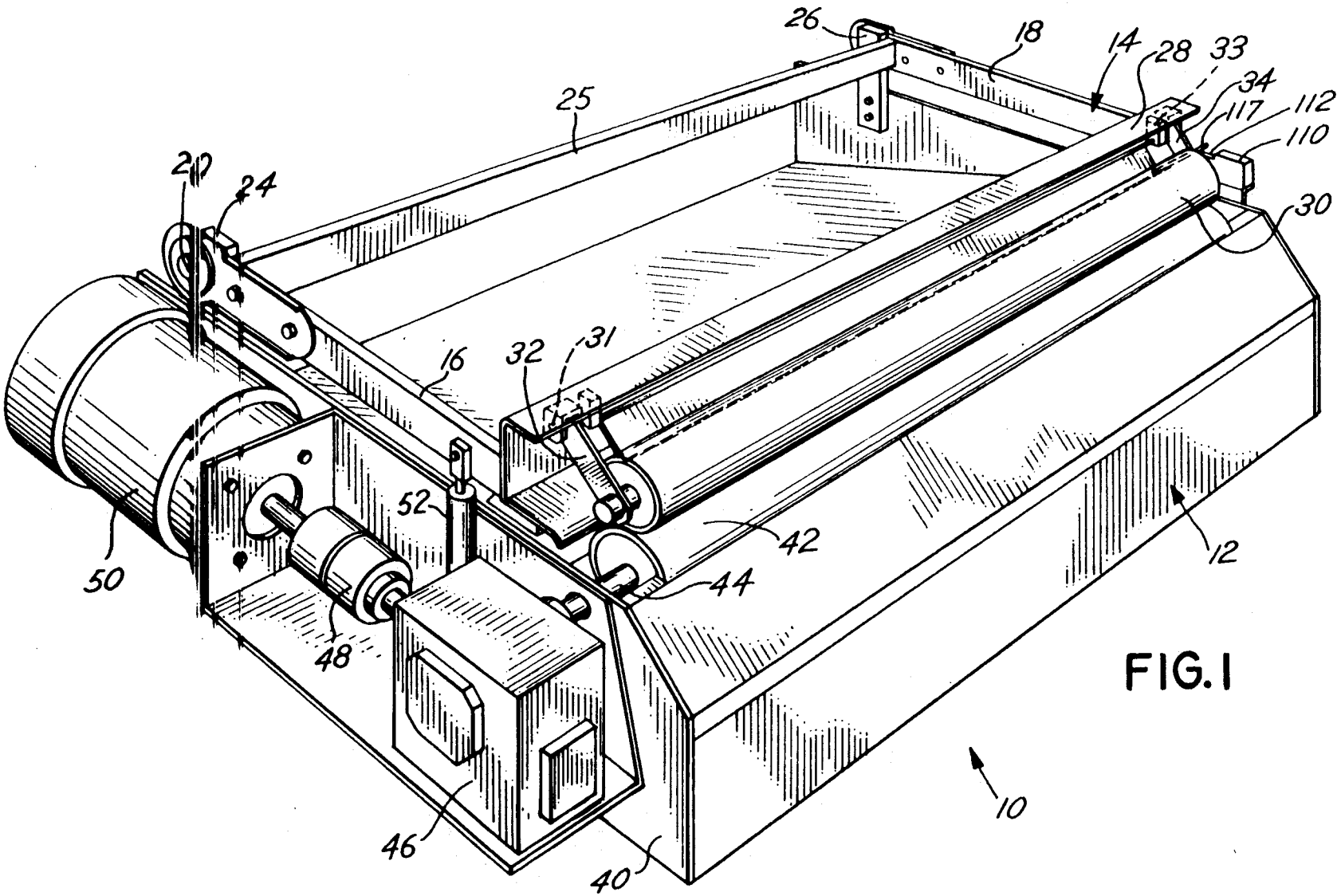
FIG. 1 is a perspective view of the machine for feeding and cutting material of the present invention, which includes an upper framework pivotally mounted on a housing.
Figure 2:
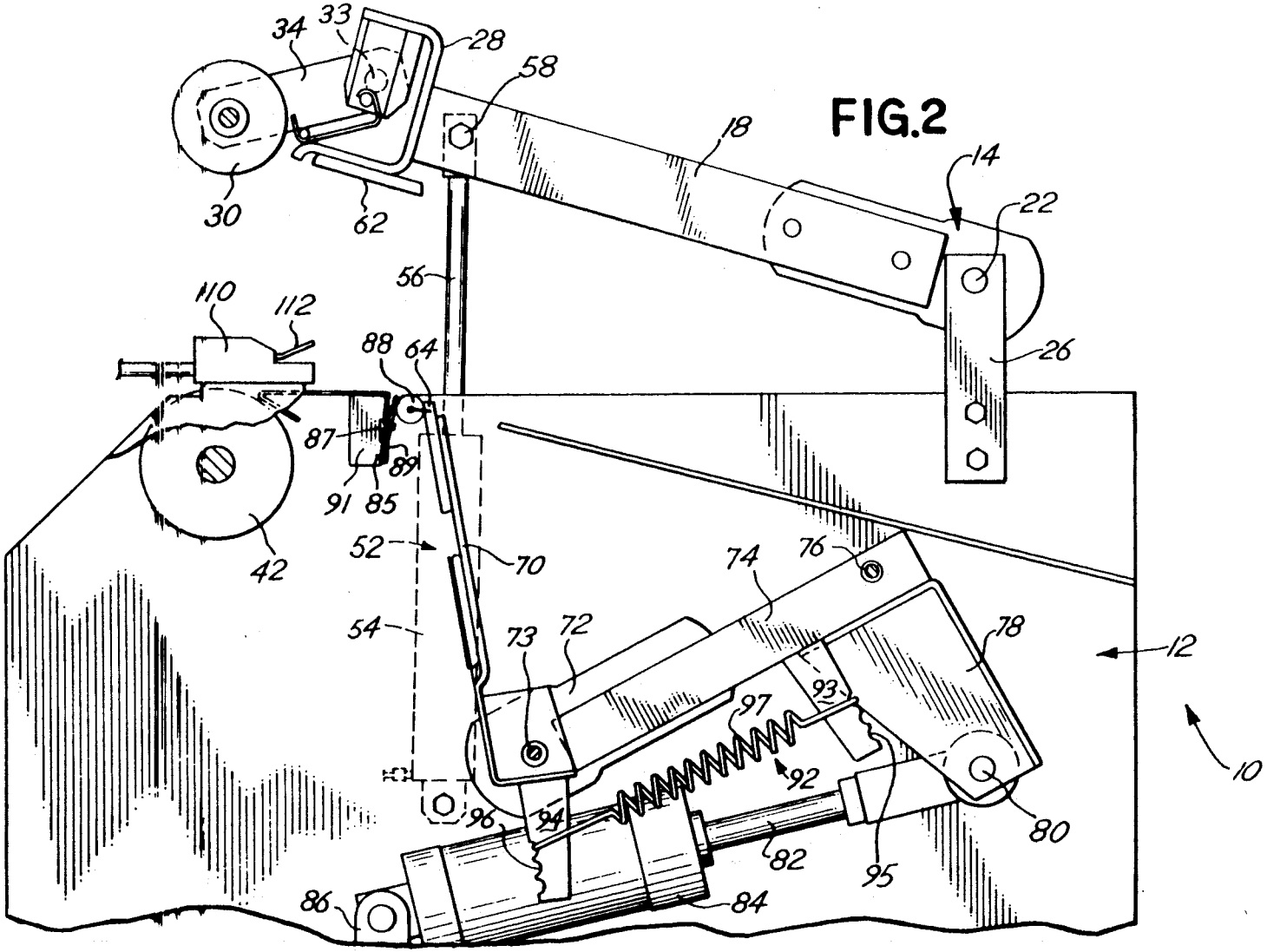
FIG. 2 is a right side view thereof, with the upper framework open.
Figure 3:
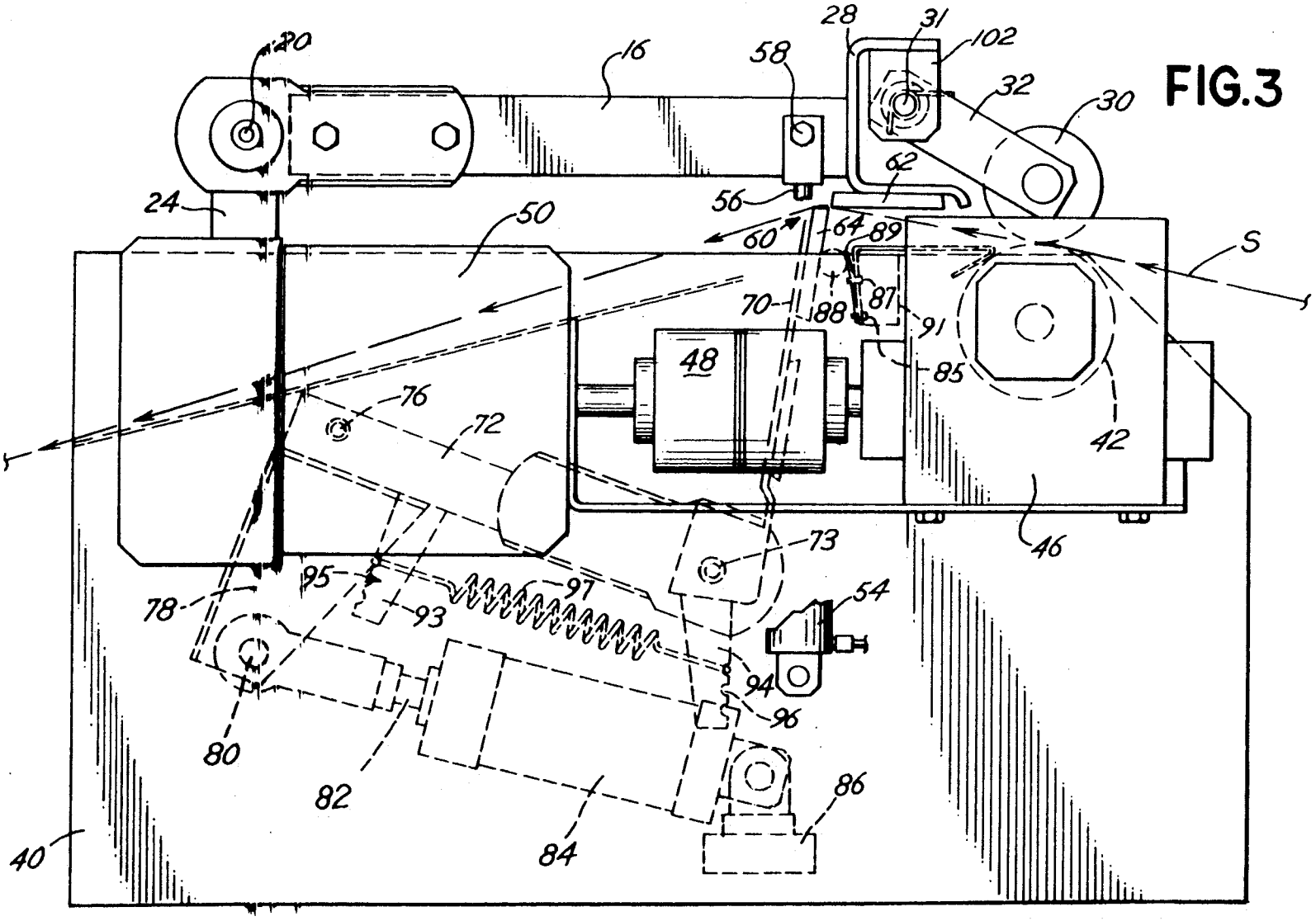
FIG. 3 is a left side view thereof, with the upper framework closed.

Referring to FIGS. 1-3, there is illustrated the machine for feeding and cutting sheet material of the present invention. The machine 10 may be supported on a frame or table in use. The machine 10 includes a housing 12 and an upper framework 14 pivotally supported thereon and movable between a closed position, as seen in FIGS. 1 and 3 and an open position as seen in FIG. 2.

The upper framework 14 comprises side arms 16 and 18 pivoted at 20 and 22 on brackets 24 and 26 carried on the rear of the housing 12. The front of the side arms 16 and 18 are connected to a channel 28 which extends transversely on the machine 10. A cross brace 25 interconnects the rear ends of arms 16 and 18. A pressure roll 30 is journalled at its ends in arms 32 and 34 that are pivotally supported on the cross beam or channel 28 at

31 and 33. The arms 32 and 34 are adjustably biased by uniquely mounted spring means, as will be described more fully later, in order to adjust the force applied to the pressure roll in use. A cover (not shown) may be fixed directly to the upper framework 14 to enclose same or alternately can be secured to the housing 12 and extend over the upper framework.

The housing 12 comprises a box-like frame 40 with front, rear, and side walls. Feed roll 42 extends transversely of machine 10 and is substantially coextensive in length with pressure roll 30. The exterior surface of the feed roll 42 is normally covered by a non-slip material, e.g., rubber. At one end, shaft 44 of feed roll 42 is connected to gear reducer 46, which in turn is connected via drive clutch 48 to a motor drive 50. Actuation of the motor drive 50, which may be electric, hydraulic, or air, but preferably is electric, will rotate the feed roll 42.

The upper framework 14 may be raised manually or by cylinder means 52 on the machine. Preferably, there is a cylinder means 52 at each side of machine 10, one for each of the arms 16 and 18 of the upper framework 14. Cylinder means 52, which are preferably air actuated, comprise a cylinder 54 secured at one end to housing 12 and an actuating rod 56 extending from the cylinder 54 and secured pivotally at its upper end as indicated at 58 to side arm 18. When actuating rod 56 is extended from cylinder 54, upper framework 14 will be opened to permit loading of the sheet material to be cut, or to clear a problem (see FIG. 2). When actuating rod 56 is retracted into cylinder 54, the framework 14 will be closed, and feed roll 42 and pressure roll 30 will be in cooperative association with sheet material therebetween. It will be understood that the cylinder means 52 on each side of machine 10 are joined together in operation. For example, the cylinder means 52 may be air cylinders connected to a common control for conjoint operation. Actuation of the motor drive 50 through a suitable control (not shown) will cause a timed or predetermined rotation of the motor drive 50 to cause a predetermined rotation of the feed roll 42 to advance a predetermined length of sheet material, e.g., paper or corrugated paper, or cardboard, fed from a supply roll into the machine.

Then, knife means 60 carried on the housing 12 and cover 14 are actuated to cut a predetermined length of sheet material. The knife means 60 comprises a knife blade 62 secured to channel 28 and extending transversely at least the maximum width of sheet material to be cut. The knife blade 62 is fixed to channel 28 and is movable therewith. In use, the knife blade 62 is stationary. The knife means 60 also comprise a knife blade 64 that cooperates with knife blade 62 when framework 14 is closed, as shown, e.g., in FIGS. 1 and 3, to cut a predetermined length of the sheet material. Knife blade 64 extends transversely of the machine 10 and is substantially coextensive in length with the knife blade 62. Knife blade 64 is fixedly secured to support frame 70 that is carried on link 72 that is in turn pivotally joined at 73 to lever 74. Lever 74 is pivotally secured to housing 12 at 76. Lever 74 includes a depending portion 78 that is connect via pivot 80 to actuating rod 82. The rod 82 is driven from cylinder 84 which is pivotally secured to a bracket 86 on housing 12. When rod 82 is drawn into cylinder 84, lever 74, 78 will be pivoted counter clockwise as seen in FIG. 3 and knife blade 64 will be raised past the rear edge of knife blade 62 to cut any sheet material therebetween. When rod 82 is extended from cylinder 84, the lever 74, 78 will be pivoted in the opposite direction and knife blade 64 will be moved downwardly to the position shown in FIG. 2.

Cam follower bearing 88 rotably carried on frame 70 will help guide knife blade 64 for proper engagement with the rear of the knife blade 62. The cam follower bearing 88 acts against a leaf spring 89 in guide block 91. The leaf spring 89 is mounted at its lower end to a flange on guide block 91 by one or more screws 85. An adjustment screw 87 selectively positions the upper end of leaf spring 89 with respect to cam follower bearing 88. The leaf spring 89 force applied to cam follower bearing 88 may be adjusted by adjustment screw 87.

The force with which knife blade 64 is urged against the edge of knife means 62 is adjustable through novel adjustment means 92. The adjustment means 92 are comprised to a plate 93 fixed to and projecting from lever 74 and a plate 94 fixed to and projecting from link 72. Each plate 93, 94 is provided with notches 95, 96, respectively for receiving the ends of a biasing spring 97. When the ends of spring 97 are affixed in the uppermost notches 95, 96 in the plates 93, 94 the least amount of force is applied to knife blade 64 urging same against cam follower bearing 88. When the ends of spring 97 are affixed in the lower most notches 95, 96 in the plates 93, 94, the most torque is created and the net amount of force is applied to knife blade 64 urging same against cam follower bearing 88.

Figure 4:
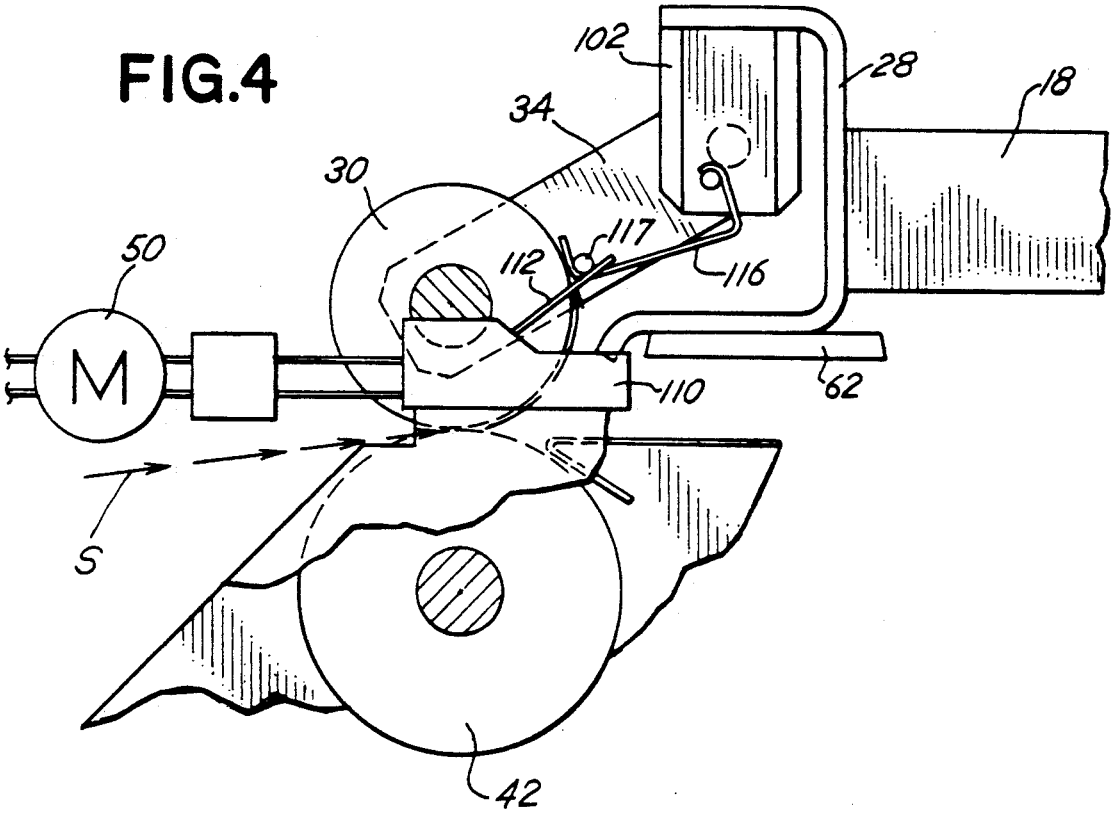
FIG. 4 is a detail view of the safety interlock switch.

With reference to FIG. 4, there is shown the safety switch means for terminating operation of the machine in the event of a jam or foul in the feed of the sheet material. The arrows indicate the feed of sheet material in the event of a foul in the feed. The safety switch means may include switch 110, which is in circuit with the drive motor 50 is a normally open switch and switch arm 112 is normally up. Interlock link 116 on cover 14 includes a stub shaft 117 that is normally engaged with switch arm 112 and retains same closed. Sheet material jamming between pressure roller 30 and channel 28 will cause interlock link 116 to rise and release switch arm 112 to open switch 110 and thus stop the electric motor drive 53. If the cover 14 is pivoted open, stub shaft 117 will release from switch arm 112 of switch 110, switch 110 will be opened and it will not be possible to operate motor 53.

Though the control means are not shown as the details thereof form no part of this invention, it is understood the machine 10 may be operated manually by a button on the control means, by a foot pedal or automatically. The control means includes an encoder assembly, by which the length of sheet material to be cut can be preset and by which the number of lengths to be cut can be preset.

Figure 5:
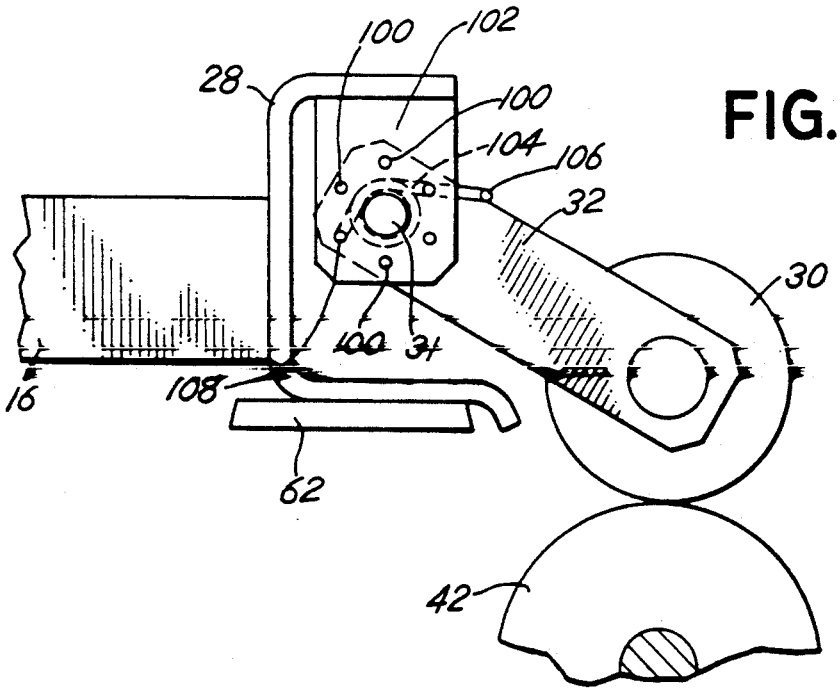
FIG. 5 is a detail view of the adjustment for the pressure roll on the upper framework.

Turning to FIG. 5, there is best shown the means for adjusting the force with which the pressure roll 30 is moved downwardly against the feed roll 42 and thus the force applied to sheet material fed into machine 10. A plurality of holes or recesses 100 are provided in bracket 102 which depend from channel 28 on cover 14. One end 108 of spring 104 engages in a selected hole 100 and the other end 106 of spring 104 engages the top of an arm 32. If end 108 of spring 104 were placed in the adjacent higher hole 100, the pressure of spring 104 against arm 32 would be increased. If the end 108 of spring 104 were placed in the adjacent lower hole 100, the pressure of spring 104 against arm 32 would be decreased. This adjusting arrangement for the pressure roll 30 is reliable and relatively simple to accomplish.

While we have shown a presently preferred embodiment of the present invention, it is apparent that the invention may be otherwise embodied within the scope of the following claims.

We claim:

1. A machine for feeding and cutting sheet material comprising a frame means, feeding means for feeding the sheet material in a first direction including feed roll means and pressure roll means cooperating therewith, feed roll drive means carried on the frame means for driving the feed roll means, a frame work pivoted on the frame means and moveable between operating position and open position, said pressure roll means being carried on said framework, upper knife means carried on said framework, said upper knife means extending transversely of said first direction, a moving knife on the frame means cooperating with the upper knife means carried on said frame work and extending transversely of said first direction, actuating means for actuating said moving knife selectively to cut sheet material passing between the upper knife means and the moving knife, a cam follower bearing on the frame means for guiding the moving knife for proper engagement with said upper knife means, said actuating means comprising cylinder means which include a cylinder and an actuating arm, said actuating arm being connected to a pivot arm pivoted on the frame means and secured to the moving knife, said pivot arm including a first portion and a second portion pivoted thereon and means for biasing the two portions so as to bias the moving knife into engagement with the cam follower bearing, and adjusting means for adjusting the force applied between the moving knife and the upper knife means, said adjusting means comprising a first projection extending from the first portion of the pivot arm, said first projection having first engaging means, a second projection extending from said second portion, said second projection having second engaging means, and a spring engaging between said first engaging means and said second engaging means, said first engaging means comprising a plurality of notches and the second engaging means comprising a plurality of notches, the spring being positioned over selected notches to adjust the force of the moving knife against the cam follower bearing.

2. A machine as in claim 1 including means adjustably biasing the pressure roll on the framework.

3. A machine as in claim 1 including safety switch means responsive to a sheet material jam to terminate operation of the feed roll drive means.

4. A machine as in claim 1 including a safety switch means responsive to a sheet material jam or the open position of the pressure roll to terminate or preclude operation of the feed roll drive means.

5. A machine as in claim 1 including spring means cooperating with and biasing the cam follower bearing.

* * * * *